US005415138A

United States Patent [19]

Hudson

[11] Patent Number: 5,415,138

[45] Date of Patent: May 16, 1995

[54] PUSHROD GUIDE FOR AN OVERHEAD VALVE ENGINE AND METHOD OF INSTALLING THE SAME

[75] Inventor: Eric B. Hudson, Hilbert, Wis.

[73] Assignee: Brunswick Corporation, Lake Forest, Ill.

[21] Appl. No.: 203,344

[22] Filed: Feb. 28, 1994

[51] Int. Cl.[6] ..... F01L 1/14; F01L 1/18

[52] U.S. Cl. ..... 123/90.43; 123/90.61

[58] Field of Search ..... 123/90.39, 90.41, 90.42, 123/90.43, 90.45, 90.61

[56] References Cited

U.S. PATENT DOCUMENTS

| | | | |
|---|---|---|---|
| 3,048,156 | 8/1962 | Van Slooten | 123/90.61 |
| 3,086,507 | 4/1963 | Mooney, Jr. | 123/90.61 |
| 3,195,527 | 7/1965 | Eaton | 123/90.61 |
| 3,301,241 | 1/1967 | Iskenderian | 123/90.61 |
| 4,856,467 | 8/1989 | Kronich | 123/90.43 |

*Primary Examiner*—Andrew M. Dolinar
*Assistant Examiner*—Weilun Lo
*Attorney, Agent, or Firm*—Wood, Phillips, VanSanten, Clark & Mortimer

[57] ABSTRACT

Difficulties with wear and the cost of guide systems for pushrods and overhead valve engines are reduced in an overhead valve internal combustion engine of the type having a block (10) with at least one cylinder (12), a head (26) fitted to the block (10), a valve (32) mounted for reciprocating movement in the head (26) toward and away from the cylinder (12) and a rocker arm (56) rockably mounted on the head (26). The rocker arm (56) abuts the valve (32) oppositely of the cylinder (12) and aligned pushrod cavities (72), (74) are respectively provided in the head (26) and block (10). A reciprocal pushrod (64) is disposed in the cavities (72), (74) and engages the rocker arm (56) oppositely of the valve (32). According to the invention, guides in the form of two spaced pins (78), (80) are disposed in one of the cavities (72) and are laterally spaced a distance about equal to the thickness of the pushrod (64) and are also spaced in the direction of reciprocation (82) of the pushrod (64).

11 Claims, 2 Drawing Sheets

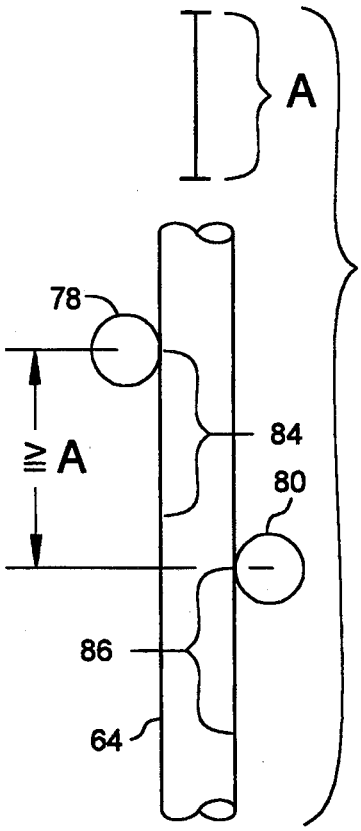
FIG. 3
FIG. 2
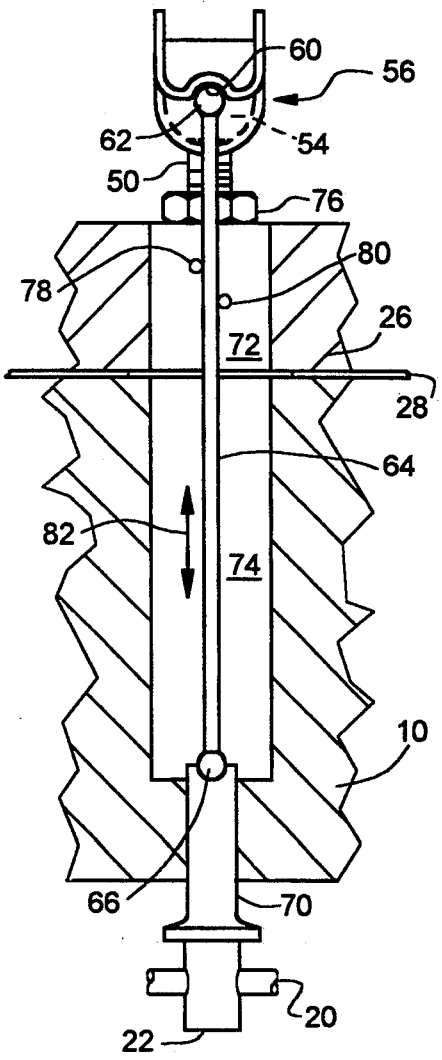
FIG. 4
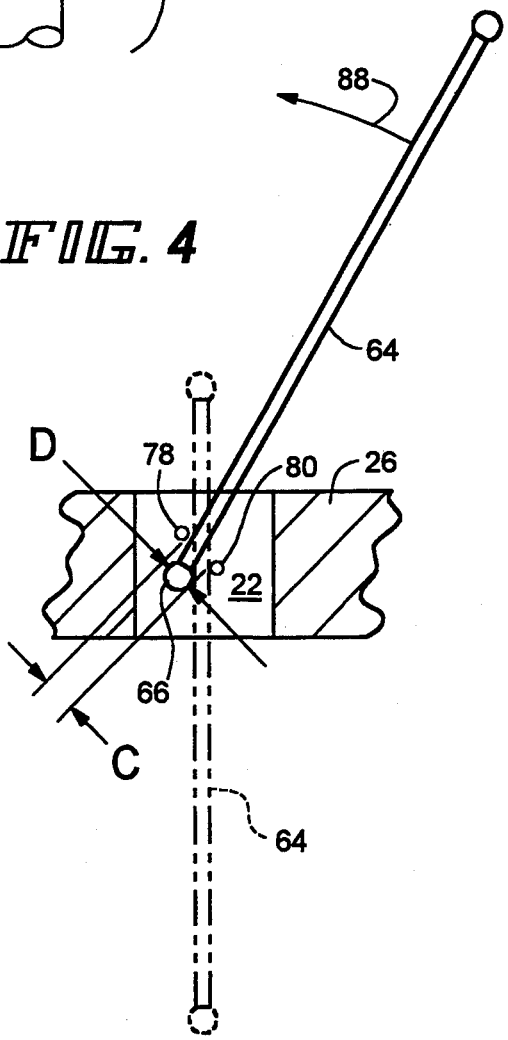

PUSHROD GUIDE FOR AN OVERHEAD VALVE ENGINE AND METHOD OF INSTALLING THE SAME

FIELD OF THE INVENTION

This invention relates to reciprocating internal combustion engines, and more particularly, to a pushrod guide for that variety of such engines known as overhead valve engines. It also relates to a method of installing a guided pushrod in such an engine.

BACKGROUND OF THE INVENTION

In overhead valve engines, valves are reciprocally mounted in the head and moved toward the cylinder to open. In many such engines, opening movement is imparted by the action of a so-called rocker arm which is a lever mounted intermediate its ends to the head for rocking movement thereon. One end of the rocker arm engages the valve stem, that is, the end of the valve opposite the cylinder, while the other end of the rocker arm is engaged by a pushrod which in turn is operated by the engine cam shaft, typically via a tappet or other valve lifter.

In many engines, the rocker arms are not mounted for movement about a fixed axes. More typically, a semi-spherical bearing is employed and as a consequence, rocker arm movement is not confined to a plane, even though it is highly desirable, as is well known, to confine the rocking movement of the rocker arm about its pivot to a single plane.

To achieve this, the prior art has generally resorted to the use of various types of guide structures. The guides typically are caused to engage the pushrod to confine its movement to reciprocation within the intended rocking plane of the rocker arm. Thus, in U.S. Pat. No. 4,856,467, issued Aug. 15, 1989, to Kronich, there is disclosed a guide plate which is anchored to the head of the engine via a nut on the rocker arm stud. The mounting plate includes spaced, parallel, coplanar guide surfaces which engage the pushrod on opposite sides intermediate its ends.

Because it is desirable to minimize the mass of the pushrod, while at the same time maximize the size of bearing surfaces at the ends of the pushrods to minimize the stresses thereat, many pushrods have enlarged ends and are relatively narrow intermediate their ends. Thus, in the Kronich patent, it is necessary to provide enlarged holes in the guide plate adjacent the ends of the guide surfaces so as to allow insertion of the enlarged end of the pushrods through the guide plate during pushrod installation.

This type of structure, while performing its intended function of guiding the pushrods, has a number of disadvantages. For one, the guide scheme is relatively complex in terms of intricacies of the pushrod receiving apertures in the guide plate and the need to provide opposed guiding surfaces and as well as an enlarged opening to facilitate installation. For another, the placing of the guide plate against the head of the engine to be held in place by the rocker arm stud may, in some instances, undesirably increase the height of the valve train proportional to the thickness of the guide plate.

For still another, because the guide surfaces are coplanar, wear will be occurring at the same location on diametrically opposite sides of the pushrod thereby reducing its life at an accelerated rate as, for example, compared to a guide system that causes wear on a pushrod only on one side thereof at any given point intermediate its ends.

The present invention is directed to overcoming one or more of the above problems.

SUMMARY OF THE INVENTION

It is a principal object of the invention to provide a new and improved pushrod guide construction for use in an overhead valve internal combustion engine. It is also an object of the invention to provide a method of installing a guided pushrod in such an engine.

According to one embodiment of the invention, the foregoing object is achieved in an overhead valve internal combustion engine having a block with at least one cylinder, a head fitted to the block, valves mounted for reciprocal movement in the head toward and away from the cylinder, and a rocker arm for each valve, rockably mounted on the head. Each rocker arm abuts a respective one of the valves oppositely of the cylinder. Aligned pushrod cavities are located in the block and in the head and reciprocal pushrods are disposed in the cavities and engage an associated rocker arm oppositely of its respective valve. Guides are located in one of the cavities for the pushrods.

According to the invention, at least one of the guides is made up of two spaced pins projecting across one of the pushrod cavities. The pins are laterally spaced a distance about equal to the thickness of the associated pushrod and sandwich the same. The pins may also be spaced in the direction of reciprocation of the pushrods.

The use of pins provides a simplified guide structure and the spacing of the pins in the direction of reciprocation of the pushrod provides the ability to achieve a pair of different advantages as will appear hereinafter.

In one form of the invention, the pushrods have enlarged ends and are of lesser thickness between their ends. The lateral spacing between the pins is about equal to the lesser thickness and the directionally measured spacing between the pins is at least slightly greater than the dimension of the enlarged ends measured generally transverse to the direction of reciprocation of the pushrods. When this relationship is followed, a preferred method of installing the guided pushrod may be utilized.

According to another aspect of the invention, each pushrod is movable in its direction of reciprocation through a predetermined increment of travel and the spacing of the pins in the direction of reciprocation of the pushrod is at least equal to the increment. This feature of the invention minimizes wear by causing wear to exist only on one side of the pushrod at any given point along its length. In other words, when the guide surfaces are staggered along the path of reciprocation of the pushrod, the wear area on the pushrod at any given point along the length of the pushrod is on only one side thereof and not on both sides thereof as in prior art constructions.

In a preferred embodiment, the pins project across the pushrod cavity in the head.

A preferred method of installing a guided pushrod according to the invention is also disclosed. It is a method of installing a guided pushrod having enlarged ends in an overhead valve internal combustion engine which includes the steps of:

(a) placing two parallel guide surfaces along opposite sides of the path of travel of the pushrod at positions laterally spaced from one another a distance about equal to the thickness of the pushrod intermediate its ends and directly spaced from one another a distance at least in excess of the dimension of the enlarged ends;

(b) introducing one of the enlarged ends into the space between the guide surfaces by moving the pushrod toward the guide surfaces at an acute angle to the path of travel of the pushrod when installed; and (c) after the enlarged end has passed through the space between the guide surfaces, angularly shifting the pushrod into its intended path of travel.

Other objects and advantages will become apparent from the following specification taken in connection with the accompanying drawings.

DESCRIPTION OF THE DRAWINGS

FIG. 2 is a sectional view taken approximately along the line 2—2 in FIG. 1;

FIG. 3 is an enlarged, fragmentary view of the pushrod guide; and

FIG. 4 is a view similar to FIG. 2 but illustrating a step in the installation of the pushrod and with various other components omitted for clarity.

DESCRIPTION OF THE PREFERRED EMBODIMENT

Figure 1:
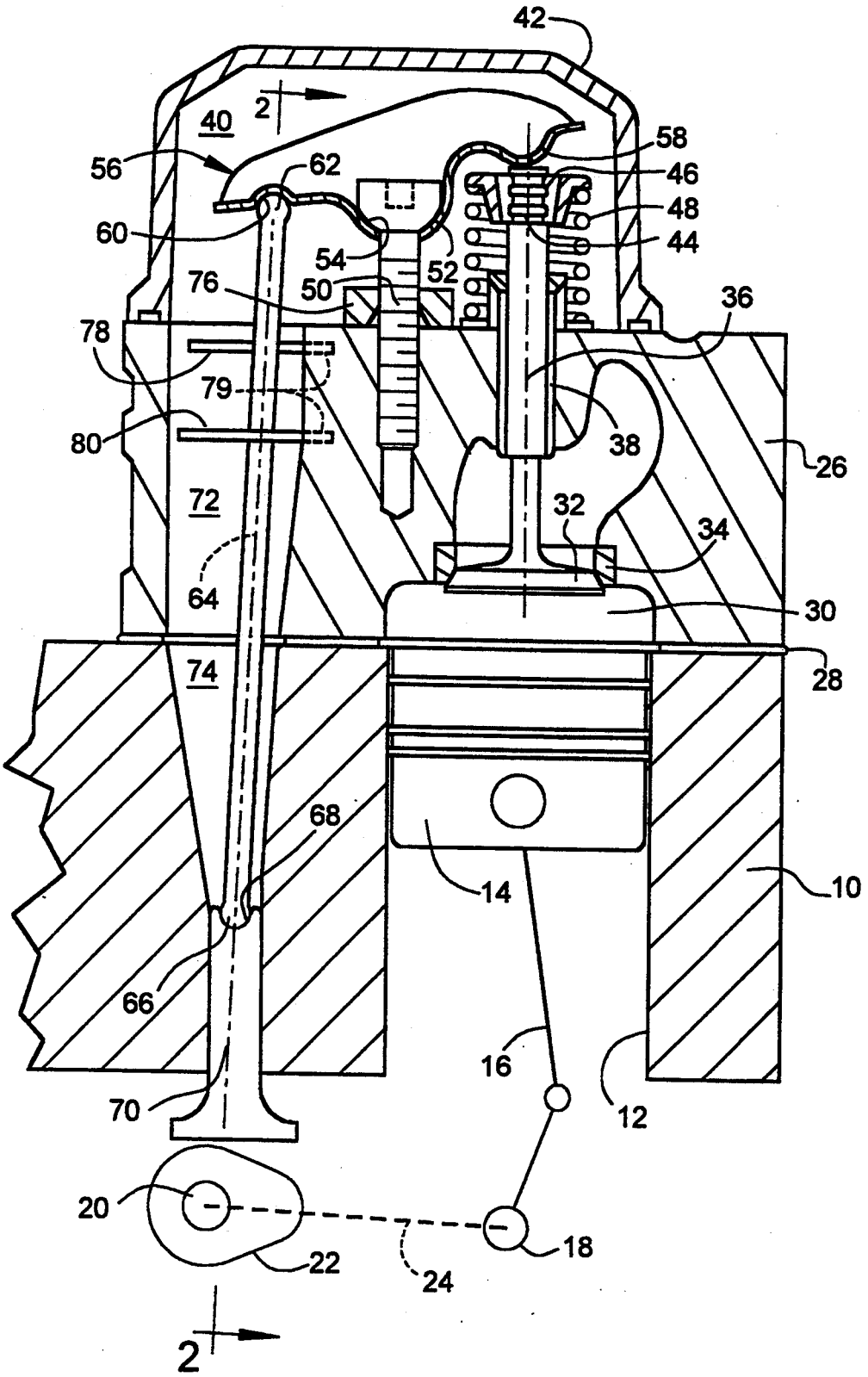
FIG. 1 is a sectional view, partially schematic, of an internal combustion engine embodying the pushrod guide of the present invention.

An exemplary embodiment of a pushrod guide for an overhead valve internal combustion engine is illustrated in the drawings and with reference to FIG. 1 is shown in the environment of an internal combustion engine having a block 10. The block 10 may be liquid cooled or air cooled. At least one cylinder 12 is located within the block 10 and a piston 14 is mounted for reciprocation within the cylinder 12 via a connecting rod shown schematically at 16 connected to the engine main shaft or crank shaft 18 as is well known.

A cam shaft shown schematically at 20 and bearing a series of cams 22 (only one of which is shown) is conventionally linked as shown diagrammatically at 24 to the main shaft 18.

An engine head 26 is secured to the block 10 in any conventional fashion to close the cylinder 12. As is well known, a gasket 28 may be interposed between the block 10 and the head 26.

The head contains a cavity 30 opening to the cylinder 12 above the piston 14 which serves as a combustion chamber. As is well known, in a conventional four stroke engine of the overhead valve variety, at least two valves 32 closable against seats 34 in the head 26 are mounted for reciprocating movement relative to the cylinder 12 between open and closed positions. FIG. 1 shows the valve 32 in a closed position.

Oppositely of the cylinder 12, each valve 32 includes a valve stem 36 mounted for reciprocating movement in a valve guide 38 within the head 26. The stem 36 extends beyond the head into an area 40 closed by a conventional valve cover 42. At its end 44 opposite from the cylinder 12, the valve 32 includes a conventional valve spring retainer 46. A biasing spring 48 is interposed between the head 26 and the valve spring retainer 46 about the stem 36 to bias the valve 32 toward its closed position.

A rocker arm stud 50 is threaded into the head 26 adjacent each of the valves 32. At its end opposite the head 26, the stud 50 includes a semispherical bearing surface 52. The bearing surface 52 nests in a semispherical recess 54 in a rocker arm, generally designated 56 to mount the latter for rocking movement within the area 40.

The rocker arm 56 extends to either side of the bearing surface 54 and includes a nose-like surface 58 which bears against the end 44 of the stem 36 of the valve 32. On the end of the rocker arm 56 opposite nose like surface 58, the rocker arm 56 includes a downwardly facing semispherical recess 60 which receives the large end 62 of a pushrod 64. As can be seen in FIG. 1, the pushrod 64 is narrow intermediate its ends including the enlarged end 62 and an opposite, enlarged end 66. By this construction, the weight of the pushrod 64 is minimized and yet relatively large bearing surfaces may be disposed at its opposite ends to minimize contact stress thereat.

In any event, the enlarged end 62 is received in the semispherical recess 60 in the rocker arm 56 while the enlarged end 66 is received in a semispherical recess 68 in the end of a tappet 70 which in turn bears against the cam 22.

The pushrod 64 extends between the rocker arm 56 and the tappet 70 via a pushrod cavity 72 in the head and a pushrod cavity 74 in the block 10. The lower end of the latter serves to conventionally mount the tappet 70 for reciprocating movement in response to rotation of the cam 22.

As is well known, proper adjustment of the valve train just described may be achieved by appropriately adjusting the rocker arm stud 50 within the head 26. If desired, a locknut 76 which is threaded about rocker arm stud 50 and abuts the head 26 may be utilized to assure that a desired position of adjustment is retained.

According to the invention, guiding of the pushrod 64 as it reciprocates through an increment of movement sufficient to move the valve 32 between open and closed positions in response to rotation of the cam 22 is achieved through the use of two pins 78 and 80 located in one of the pushrod cavities 72 and 74, and preferably, the pushrod cavity 72 located in the head 26 of the engine. In this regard, it is preferable to locate the guide structure as close as possible to the interface of the pushrod and the rocker arm 56 to minimize any excursion of the pushrod 64 and rocker arm 56 to one side or the other of the plane in which the rocker arm is intended to rock.

According to the illustrated embodiment of the invention, the guide pins 78 and 80 extend across the cavity 72 with the ends thereof pressed into holes 79 provided in the head 26 as can be seen in FIG. 1. Turning to FIG. 2, it will be seen that the two are spaced a distance in the lateral direction, that is, from side to side or in the direction transverse to the intended direction of reciprocation of the pushrod 64 indicated by an arrow 82 a distance that is about equal to the thickness of the pushrod 64 intermediate its ends 62, 66. As a consequence, it will be appreciated that movement of the upper end of the pushrod 64 is confined generally to a plane extending into and out of the paper at right angles as viewed in FIG. 2.

In the preferred embodiment of the invention the pins 78 and 80 are also spaced in the direction along the path of reciprocation of the pushrod 64 as indicated by the arrow 82. Stated another way, the pins 78 and 80 are spaced from one another in the direction of elongation of the pushrod 64 as well.

As is well known, during operation of the engine, the pushrod 64 will move in its path of travel an increment sufficient to pivot the rocker arm 56 sufficiently to move the valve 32 between opened and closed positions. The spacing between the pins 78 and 80 in the direction of elongation of the pushrod 64 is at least equal to this increment. When this relationship is adhered to, it will be appreciated that for an increment of movement shown at "A" in FIG. 3, wear caused by the pin 78 will occur only at that part of the pushrod 64 encompassed by the bracket 84. Similarly, wear caused by the pin 80 will occur only on that part of the pushrod 64 embraced by the bracket 86. As can be readily appreciated from FIG. 3, if the aforementioned spacing is provided, the areas 84 and 86 do not overlap and consequently, the wear at any point on the pushrod 64 caused by engagement with the guides will be reduced by one-half over that which may occur during operation of the prior art device.

According to the invention, the distance or spacing between the pins 78 and 80 is also such that when measured directly will exceed the maximum dimension of the enlarged end 66. Referring to FIG. 4, the directly measured distance between the pins 78 and 80 is shown as "C" while the maximum dimension of the enlarged end 66 is shown as "D". It will also be appreciated that since "C" is greater than "D", the enlarged end 66 may pass between the pins 78 and 80 when the pushrod 64 is oriented at an acute angle of, say, 15°–450° or more to its intended path of reciprocation within the engine which is shown in FIG. 4 by the dotted line outline of the push rod 64. Thus, with the valve cover 42 removed, the pushrod 64 may be installed by advancing the same towards the pins 78, 80 at the aforementioned acute angle to cause the enlarged end 66 to pass between the pins 78 and 80. After that has occurred, the pushrod 64 may be angular shifted or moved in the direction of an arrow 88 in FIG. 4 to align with its intended path of travel, suitably engaged with a tappet 70 and then with the rocker arm 56 as the head 26 is installed to the block 10.

While in the preferred embodiment of the invention the pins 78 and 80 are spaced in the direction of reciprocation of the pushrods, to accept passage of an enlarged pushrod end, such spacing is not always required. Some engines employ pushrods that are not enlarged at one or both ends. In such engines, the pins 78 and 80 need not be so directionally spaced apart. While the configuration does not offer the advantage of wear reduction or distribution described above, it still provides a simple and effective low-cost pushrod guide structure.

From the foregoing, it will be appreciated that installation of the rocker arm 64 is quite simple when the method of the invention is practiced. Furthermore, the structure of the guide for the pushrod is considerably simplified over prior art construction in that only two pins, as opposed to a plate with fairly precise stampings, is required. Moreover, the reduction in wear is a sizable advantage of the invention as can be readily appreciated by those skilled in the art.

I claim:

1. In an overhead valve internal combustion engine, having a block with at least one cylinder, a head fitted to said block, valves mounted for reciprocal movement in said head toward and away from said at least one cylinder, a plurality of rocker arms, one for each valve, mounted on said head and each abutting a respective one of said valves oppositely of said cylinder, aligned pushrod cavities in said block and said head, reciprocal pushrods in said cavities and each engaging an associated rocker arm oppositely of its respective valve, and guides in one of said cavities for said pushrods the improvement wherein at least one of said guides comprises two spaced guide surfaces projecting at least partially across one of said cavities, said guide surfaces being laterally spaced relative to each other a distance about equal to the thickness of the associated pushrod and sandwiching the same, said guide surfaces also being spaced relative to each other in the direction of reciprocation of said associated pushrod.

2. The overhead valve internal combustion engine of claim 1 wherein said pushrods have enlarged ends and are of lesser thickness between said ends, the lateral spacing between said guide surfaces being about equal to said lesser thickness and the directly measured spacing between said guide surfaces being at least slightly greater than the dimension of said enlarged ends measured generally transverse to the direction of reciprocation of said pushrods.

3. The overhead valve internal combustion engine of claim 1 wherein each said pushrod is movable in a direction of reciprocation through a predetermined increment of travel and the spacing of said guide surfaces in the direction of reciprocation of said pushrods is at least equal to said increment.

4. The overhead valve internal combustion engine of claim 1 wherein said guide surfaces extend across said pushrod cavity in said head.

5. In an overhead valve internal combustion engine having a block with at least one cylinder, a head fitted to said block, valves mounted for reciprocal movement in said head toward and away from said at least one cylinder, rocker arms for each valve mounted on said head and each abutting a respective one of said valves oppositely of said cylinder, aligned pushrod cavities extending through said block and said head, reciprocal, elongated, pushrods in said cavities and each engaging an associated rocker arm oppositely of the associated valve, each pushrod being relatively narrow intermediate its ends and terminating in an enlarged end, and guides for said pushrods, the improvement wherein at least one of said guides is in said pushrod cavity and comprises two spaced pins projecting across the pushrod cavity, said pins being laterally spaced relative to each other a distance about equal to the thickness of the associated pushrod and sandwiching the same, said pins also being spaced relative to each other in the direction of elongation of said pushrods a distance sufficient that the spacing measured directly between said pins is at least slightly greater than the dimension of said enlarged end measured transverse to said direction of elongation.

6. The overhead valve internal combustion engine of claim 5 wherein said pushrods reciprocate generally in their direction of elongation through a predetermined increment and said pins are spaced in said direction of elongation a distance at least equal to said increment.

7. In an overhead valve internal combustion engine having a block with at least one cylinder, a head fitted to said block, valves mounted for reciprocal movement in said head toward and away from said at least one cylinder, a plurality of rocker arms, one for each valve, rockably mounted on said head and each abutting a respective one of said valves oppositely of said cylinder, pushrod cavities in said block and said head, elongated pushrods in said cavities and each engaging an associated rocker arm oppositely of its respecting valve and reciprocally movable through a predetermined increment sufficient to move said valves between open and closed positions, and guides in said pushrod cavities for said pushrods, the improvement wherein said guides comprise two spaced pins projecting across the pushrod cavity, said pins being laterally spaced relative to each other a distance about equal to the thickness of the associated pushrod and sandwiching the same.

8. The overhead valve internal combustion engine of claim 7 wherein the pushrod guide pins are spaced relative to each other in the direction of reciprocation of the pushrods a distance about equal to the predetermined incremental movement of the pushrods.

9. In an overhead valve internal combustion engine having a block with at least one cylinder, a head fitted to said block, valves mounted for reciprocal movement in said head toward and away from said at least one cylinder, a plurality of rocker arms, one for each valve, rockably mounted on said head and each abutting a respective one of said valves oppositely of said cylinder, aligned pushrod cavities in said block and said head, elongated pushrods in said cavities and each engaging an associated rocker arm oppositely of its respecting valve and reciprocally movable through a predetermined increment sufficient to move said valves between open and closed positions, and guides in one of said cavities for said pushrods the improvement wherein at least one of said guides is in said head cavity and comprises two spaced pins projecting across said head cavity, said pins being laterally spaced relative to each other a distance about equal to the thickness of the associated pushrod and sandwiching the same, said pins also being spaced relative to each other in the direction of reciprocation of said pushrods a distance about equal to or greater than said predetermined increment.

10. A method of installing a guided pushrod having enlarged ends in an overhead valve internal combustion engine comprising the steps of, (a) placing two parallel guide surfaces along opposite sides of a path of travel of the pushrod at positions laterally spaced from one another a distance about equal to the thickness of the pushrod intermediate its ends and directly spaced from one another a distance at least in excess of the dimension of said enlarged ends;

(b) introducing one of the enlarged ends into the space between the guide surfaces by moving said pushrod toward said guide surfaces at an acute angle to said path of travel; and (c) after said one enlarged end has passed through the space between the guide surfaces, angularly shifting the pushrod into said path of travel.

11. The method of claim 8 wherein step (a) is performed by placing pins along opposite sides of said path of travel.

* * * * *